US005104363A

United States Patent [19]

Shi

[11] Patent Number: 5,104,363

[45] Date of Patent: Apr. 14, 1992

[54] HYDRAULIC RESISTANCE TYPE STATIONARY ROWING UNIT

[76] Inventor: James Shi, No. 10, Lane 627, Sec. 4, Chung-Ching Rd., Ta-Ya Hsiang, Taichung Hsien, Taiwan

[21] Appl. No.: 761,100

[22] Filed: Sep. 17, 1991

[51] Int. Cl.[5] ..... A63P 21/00

[52] U.S. Cl. ..... 482/73; 482/72; 482/131; 128/252

[58] Field of Search ..... 272/132, 70, 96, 73, 272/72, 134, 130, 120, 144, 70.2, 116, 135; 128/25 R

[56] References Cited

U.S. PATENT DOCUMENTS 4,300,760 11/1981 Bobroff ..... 272/120
4,684,126 8/1987 Dalebout ..... 272/72
4,743,010 5/1988 Geraci ..... 272/72
4,989,858 2/1991 Young ..... 272/70
5,039,088 8/1991 Shifferaw ..... 272/72

*Primary Examiner*—Stephen R. Crow
*Assistant Examiner*—Jerome Donnelly
*Attorney, Agent, or Firm*—Townsend and Townsend

[57] ABSTRACT

An exercising device in the form of a stationary rowing unit which can be used as a physical therapy aide having its main body portion lying substantially in a horizontal plane. The unit including a seat and arm assemblies foot pedal which are pivotally connected by a reciprocating cable and a pivotal tube assembly. The foot pedals being pivotally connected to the arm assemblies by rigid connecting rods and a pair of resistance cylinder means each pivotally mounted between respective foot pedals and the frame on opposite sides of the body for providing a desired resistance to movement by the user.

3 Claims, 4 Drawing Sheets

HYDRAULIC RESISTANCE TYPE STATIONARY ROWING UNIT

BACKGROUND OF THE INVENTION

1. Field of the Invention

The invention relates to a stationary rowing unit, and more particularly to a hydraulic resistance type stationary rowing unit that can be used as a physical therapy aid.

2. Description of the Related Art

Since the purpose of conventional stationary rowing units is to exercise the limbs of a normal user, conventional rowing unit constructions cannot be used by patients undergoing physical therapy to cure partial paralysis caused by a stroke. The conventional stationary rowing units would have to be modified in order to permit the normal limbs of a patient to operate the stationary rowing unit so as to gradually exercise and move the injured limbs.

SUMMARY OF THE INVENTION

Therefore, the main objective of the present invention is to provide a stationary rowing unit which can be used as a physical therapy aide.

Specifically, the main objective of the present invention is to provide a modified hydraulic resistance type stationary rowing unit having coordinated foot pedals and arm assemblies to thereby permit the normal limbs of a patient to operate the stationary rowing unit so as to gradually exercise and move the injured limbs.

Another objective of the present invention is to provide a stationary rowing unit which is easy and comfortable to use, and which requires minimum supervision by a physical therapist, thereby reducing the treatment fees incurred.

Still another objective of the present invention is to provide a stationary rowing unit which is adapted for use by normal people and by those who are temporarily disabled.

Accordingly, the preferred embodiment of a hydraulic resistance type stationary rowing unit of the present invention comprises: a frame assembly having a substantially horizontally extending body, a front leg unit provided on a front end of the body, a rear leg unit provided on a rear end of the body, a seat mounted on the body adjacent to the rear end of the body, a wedge shaped mounting support having a flat top side positioned at the top of the body towards the front end of the body, and a rope sheave rotatably mounted on an inclined bottom side of the mounting support and having an annular peripheral groove; a pair of elongated foot pedals pivoted on opposite sides of the body adjacent to a front end of the body, each of the foot pedals having an inner side disposed adjacent to the body and being provided with a hook at an intermediate portion of the inner side, each of the foot pedals further having a frontal side with an upper portion being provided with a foot pad and a U-shaped foot support disposed around the lower edges of the foot pad; a pair of arm assemblies disposed on opposite sides of the body and located between said seat and foot pedals, each of the arm assemblies including an L-shaped shaft having a pivot leg portion and a lever portion extending upwardly from one end of the pivot leg portion, the other end of the pivot leg portion being pivoted onto the body; a pair of connecting rods disposed on opposite sides of the body, one end of each of the connecting rods being pivoted to the frontal side of one of the foot pedals, the other end of each of the connecting rods being pivoted to the pivot leg portion of one of the arm assemblies, the connecting rods coordinating the movement of the foot pedals and the arm assemblies; a pair of hydraulic cylinder means disposed on opposite sides of the body, each of the hydraulic cylinder means including a cylinder body having a base end pivoted to the body between said seat and foot pedals, and a piston rod having a distal end coupled to the frontal side of one of the foot pedals, the hydraulic cylinder means providing resistance to the movement of the foot pedals relative to the body; and a cable provided on the annular peripheral groove of the rope sheave and having two ends each being tied to a respective ring hook, each of the two ends of the cable being selectively fastened to the hook of a corresponding one of the foot pedals.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
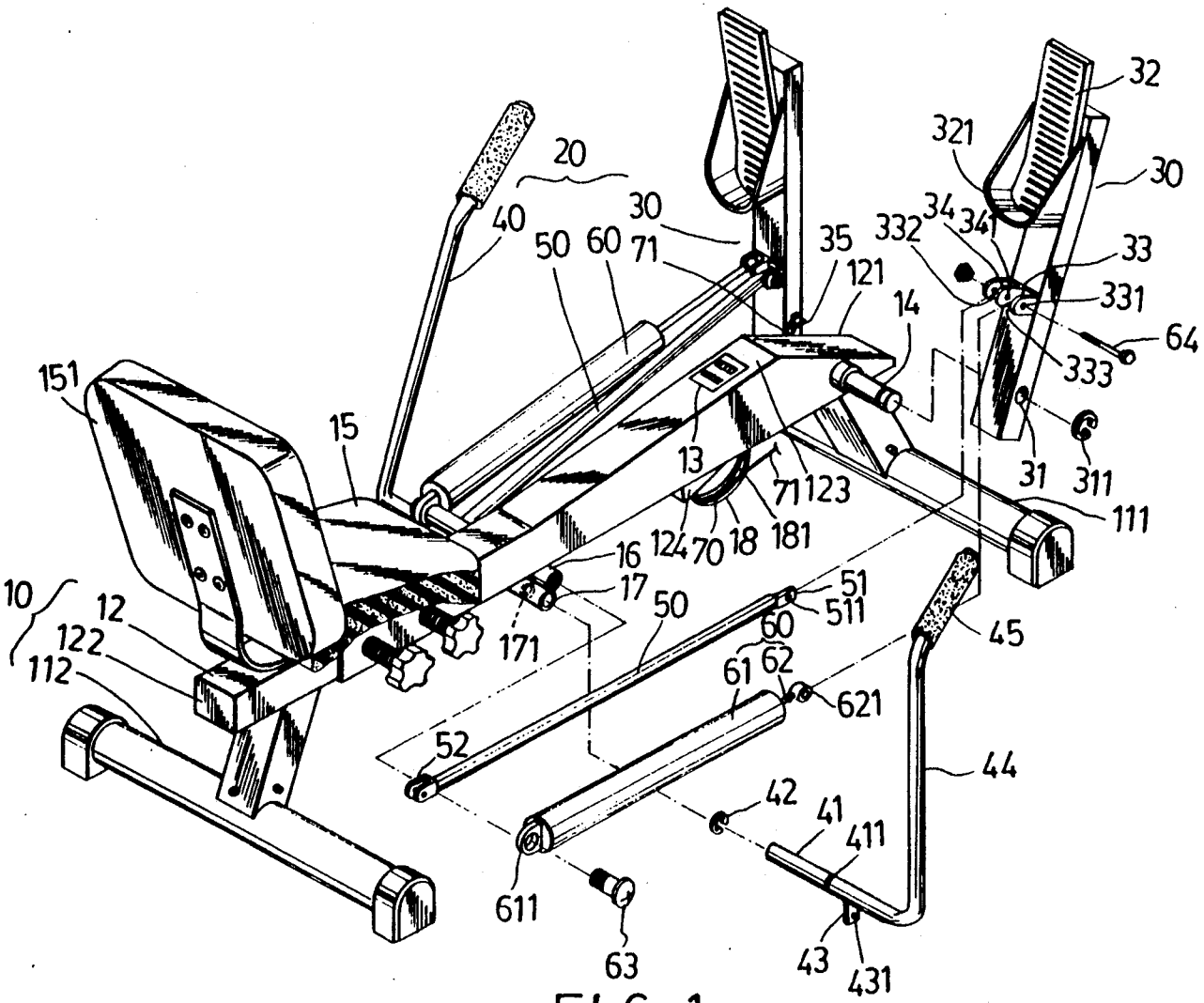
FIG. 1 is a partially exploded view of the preferred embodiment of a hydraulic resistance type stationary rowing unit according to the present invention.

Referring to FIG. 1, the preferred embodiment of a stationary rowing unit according to the present invention is shown to comprise a frame assembly 10 and a hydraulic resistance type manually operated unit 20.

The frame assembly 10 has a substantially horizontally extending body 12. The body 12 is provided with a front leg unit 111 on a front end 121 thereof, and a rear leg unit 112 on a rear end 122 of the same. The body 12 further has a top surface with an upwardly inclining portion 123 disposed adjacent to the front end 121. A rowing counter 13 is provided on the inclined portion 123 to indicate the number of rowing actions executed by the user. (The rowing counter 13 is known in the art and will not be detailed further). A pair of aligned axles 14 are disposed adjacent to the front end 121 of the body 12 and extend transversely from opposite sides of the body 12. A seat 15 is mounted on the body 12 adjacent to the rear end 122. The seat 15 has a backrest 151 to provide sitting comfort. A stationary shaft 16 and a pivot tube 17 are mounted transversely on the bottom surface of the body 12 upstream of and adjacent to the seat 15. The internal surface of the pivot tube 17 is provided with a pair of annular grooves 171, each being disposed adjacent to one end of the pivot tube 17. The frame assembly 10 further includes a wedge shaped mounting, support 124 having a flat top side positioned at the top of the body 12 adjacent to and spaced from the front end 121. A rope sheave 18 is rotatably mounted on an inclined bottom side of the mounting support 124. The rope sheave 18 has an annular peripheral groove 181.

The manually operated unit 20 includes a pair of foot pedals 30, a pair of arm assemblies 40, a pair of connecting rods 50, a pair of hydraulic cylinders 60 and a cable 70.

Each of the foot pedals 30 is preferably an upright rectangular metal casing. The lower end of the foot pedal 30 is provided with a transverse through hole 31 to pivotably mount the foot pedal 30 on one of the axles 14 on the body 12. A C-shaped locking ring 311 is provided on each axle 14 so as to prevent the untimely release of the foot pedals 30 from the axles 14. Each of the foot pedals 30 has a frontal side, the upper portion of which is provided with a foot pad 32 and a U-shaped foot support 321 disposed around the lower edges of the foot pad 32 to facilitate the positioning of the user's feet on the preferred embodiment. A U-shaped bracket 33 is secured to an intermediate portion of the frontal side of each foot pedal 30. A partitioning ear 34 divides the space confined by the U-shaped bracket 33 into pivot spaces, 332 and 333. The U-shaped bracket 33 and the partitioning ear 34 are provided with aligned fastener holes, 331 and 341. Each of the foot pedals 30 further has an inner side disposed adjacent to the body 12 and having an intermediate portion provided with a hook 35.

Each of the arm assemblies 40 includes an L-shaped shaft having a shorter pivot leg portion 41 and a longer lever portion 44 extending upwardly from one end of the pivot leg portion 41. The pivot leg portion 41 is formed with an annular groove 411 to receive a C-shaped ring 42. The C-shaped ring 42 engages with one of the annular grooves 171 of the pivot tube 17 to permit axial rotation of the pivot leg portion 41 while preventing lateral movement of the pivot leg portion 41 relative to the pivot tube 17. A thin metallic ear projection 43 extends downwardly from the pivot leg portion 41. The ear projection 43 has a through hole 431. The upper end of the lever portion 44 is bent and is provided with a tubular rubber grip sleeve 45 to provide handling comfort.

Each of the connecting rods 50 has a flat connecting end 51 provided with a mounting hole 511 to pivotably mount the same onto the pivot space 332 of the bracket 33 on one of the foot pedals 30. The other end of the connecting rod 50 is provided with a U-shaped mounting bracket 52 to pivotably mount the same onto the ear projection 43. Thus, the movement of one of the foot pedals 30 correspondingly moves one of the arm assemblies 40.

Each of the hydraulic cylinders 60 has a main cylinder body 61 and a piston rod 62. The base end of the cylinder body 61 is provided with a fastening ring projection 611. A bolt 63 extends into the opening defined by the ring projection 611 and pivotably mounts the cylinder body 61 onto one end of the stationary shaft 16. The distal end of the piston rod 62 is provided with a transverse coupling tube 621 disposed in the pivot space 333 of the bracket 33 on one of the foot pedals 30. A bolt 64 extends through the fastener holes, 331 and 341, of the U-shaped bracket 33 and the partitioning ear 34 and through the opening defined by the coupling tube 621 to couple the piston rod 62 onto one of the foot pedals 30. The hydraulic cylinders 60 provide resistance to the movement of the foot pedals 30 relative to the body 12.

The cable 70 is provided on the annular peripheral groove 181 of the rope sheave 18 Each of the two ends of the cable 70 is tied to a ring hook 71 that engages the hook 35 of a corresponding one of the foot pedals 30.

Figure 2:
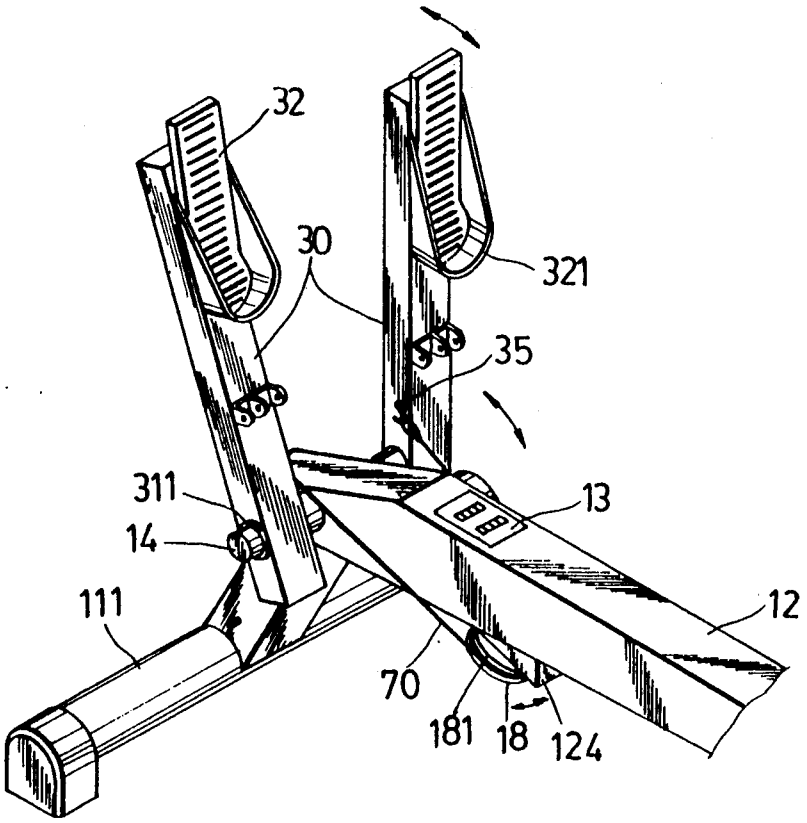
FIG. 2 is a perspective view of the front portion of the stationary rowing unit shown in FIG. 1.

The operation of the preferred embodiment is as follows:

Referring to FIGS. 1 and 2, the cable 70 permits reciprocating movement of the foot pedals 30. That is, forward movement of a left one of the foot pedals 30 causes backward movement of a right one of the foot pedals 30, and vice versa. Movement of the foot pedals 30 causes the connecting rods 50 to move and therefore cause the arm assemblies 40 to correspondingly move. Thus, regardless of where force is exerted (either of the foot pedals 30 or the arm assemblies 40), simultaneous and coordinated movement of the foot pedals 30 and the arm assemblies 40 occurs, thereby attaining an equal pacing effect.

Figure 3:
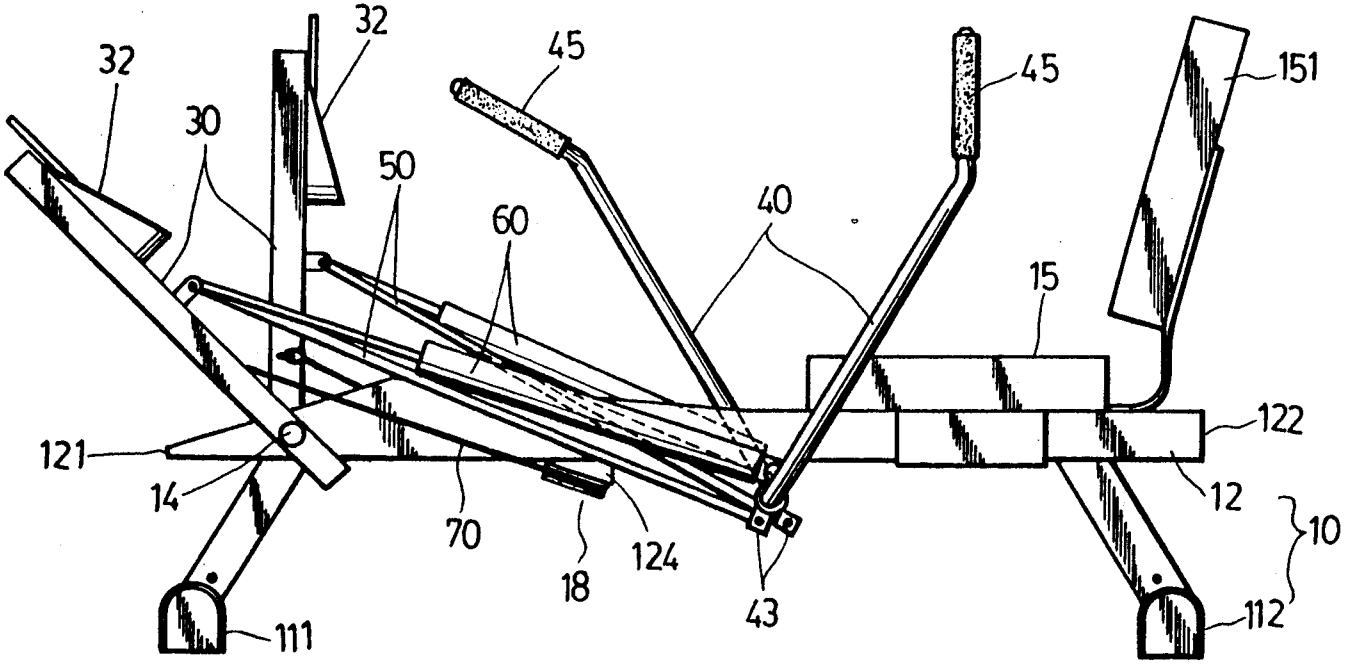
FIG. 3 is a schematic side view illustrating the first preferred use of the stationary rowing unit of the present invention.

Referring to FIG. 3, the user's feet press against the foot pads 32 and are supported by the U-shaped foot supports 321. The user's hands grip the tubular rubber grip sleeves 45. When one of the foot pedals 30 is pushed forward, the corresponding one of the connecting rods 50 moves forward to thereby move the corresponding one of the arm assemblies 40 rearward. This serves to illustrate that the foot pedals 30 and the arm assemblies 40 move in coordinated opposite directions. Note that the cable 70 permits reciprocating movement of the foot pedals 30. Thus, when the foot pedal 30 and the arm assembly 40 on one side of the body 12 are operated to move to an expanded state, the foot pedal 30 and the arm assembly 40 on the other side of the body 12 are moved to a retracted state. This construction is ideal for use by patients undergoing physical therapy to cure partial paralysis caused by a stroke. The normal limbs of a patient are used to operate and move the foot pedals 30 and the arm assemblies 40 so as to gradually exercise and move the injured limbs.

Figure 4:
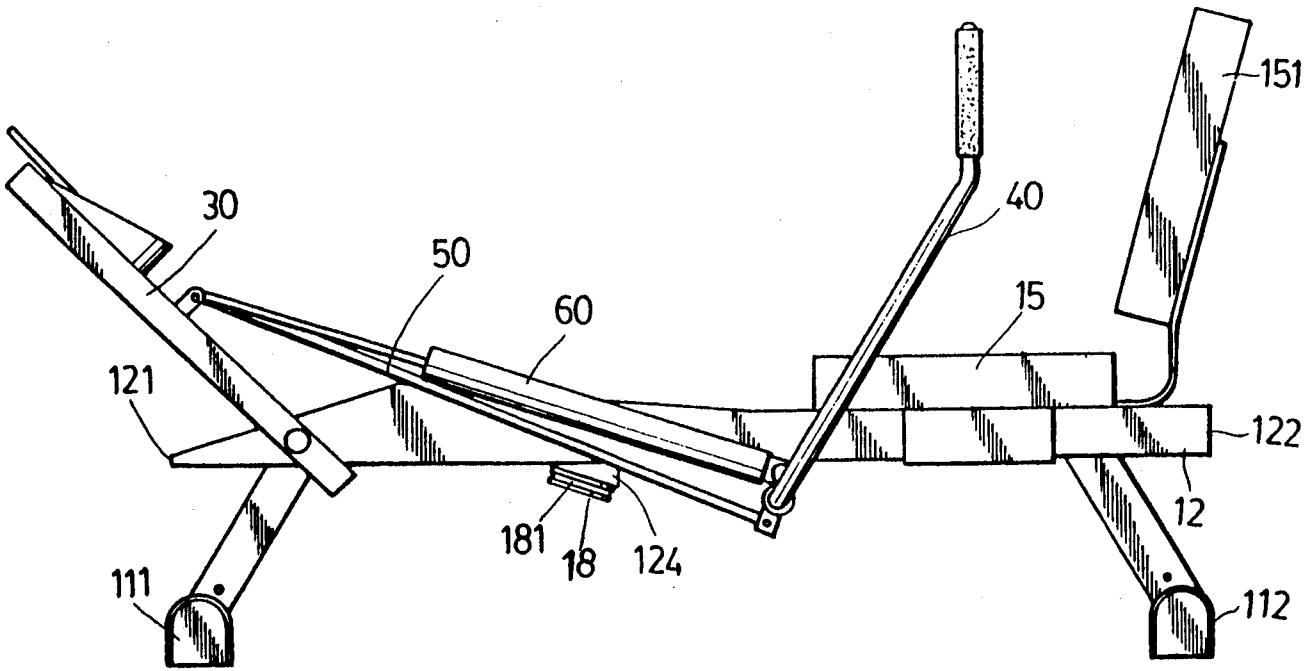
FIG. 4 is a schematic side view illustrating the second preferred use of the stationary rowing unit of the present invention.

After the patient's condition has improved, the two ends of the cable 70 may be detached from the foot pedals 30 by simply unfastening the ring hooks 71 from the hooks 35. Movement of the foot pedals 30 thus becomes independent, as shown in FIG. 4. This is in contrast with the movement of the foot pedals 30 in FIG. 3. This kind of an arrangement enables a normal person to use the preferred embodiment as an exercise machine.

The advantages and characterizing features of the preferred embodiment of a hydraulic resistance type stationary rowing unit of the present invention are as follows:

1. The preferred embodiment can be used as a physical therapy aid for patients who are partially paralyzed. The normal limbs of the patient are used to apply the required force to operate and move the foot pedals and the arm assemblies. Movement of one of the foot pedals or the arm assemblies simultaneously moves the other foot pedals and arm assemblies, thereby permitting a patient to exercise his injured limbs.

2. The preferred embodiment is comfortable to use since the patient is in a reclining position. The stationary rowing unit is also easy to use and requires minimum supervision by a physical therapist, thereby reducing the treatment fees incurred.

3. The resistance offered by the hydraulic cylinders can be adjusted to suit the patient's needs. Adjustment of the resisting force is achieved in a conventional manner (such as by varying the spring strength, adjusting the fluid pressure, etc.).

4. The cable can be detached from the foot pedals to permit a normal person to use the preferred embodiment as an exercise machine.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A hydraulic resistance stationary rowing unit, comprising:

a frame assembly having a substantially horizontally extending body, a front leg unit provided on a front end of said body, a rear leg unit provided on a rear end of said body, a seat mounted on said body adjacent to said rear end of said body, a wedge shaped mounting support, having a flat top side positioned at the top of said body towards said front end of said body, and a rope sheave rotatably mounted on an inclined bottom side of said mounting support;

a pair of elongated foot pedals pivotally mounted on opposite sides of said body adjacent to a front end of said body, each of said foot pedals having an inner side disposed adjacent to said body and being provided with a hook at an intermediate portion of said inner side;

a pair of arm assemblies disposed on opposite sides of said body and located between said seat and foot pedals each of said arm assemblies including an L-shaped shaft having a pivot leg portion and a lever portion extending upwardly from one end of said pivot leg portion, the other end of said pivot leg portion being pivotally mounted onto said body;

a pair of connecting rods disposed on opposite sides of said body, one end of each of said connecting rods being pivotally mounted to a frontal side of one of said foot pedals, the other end of each of said connecting rods being pivotally mounted to said pivot leg portion of one of said arm assemblies, said connecting rods coordinating the movement of said foot pedals and said arm assemblies;

a pair of hydraulic cylinder means disposed on opposite sides of said body, each of said hydraulic cylinder means including a cylinder body having a base end pivotally mounted to said body between said seat and said foot pedals, and a piston rod having a distal end coupled to said frontal side of one of said foot pedals, said hydraulic cylinder means providing resistance to movement of said foot pedals relative to said body; and a cable provided on said rope sheave and having two ends each being tied to a respective ring hook, each of said two ends of said cable being selectively fastened to said hook of a corresponding one of said foot pedals.

2. The hydraulic resistance stationary rowing unit as claimed in claim 1, wherein said rope sheave has an annular peripheral groove, said cable being provided on said peripheral groove to properly position said cable.

3. The hydraulic resistance stationary rowing unit as claimed in claim 1, wherein said frontal side of each of said foot pedals has an upper portion provided with a foot pad and a U-shaped foot support disposed around lower edges of said foot pad.

* * * * *